US005866184A

United States Patent [19]

Gorlich et al.

[11] Patent Number: 5,866,184

[45] Date of Patent: Feb. 2, 1999

[54] METHOD OF PACKAGING A FOOD PRODUCT IN A VENTABLE PACKAGE

[75] Inventors: Michael P. Gorlich; Robert F. McPherson, Jr., both of Hilton Head Island, S.C.; Robert C. James, Naples, Fla.

[73] Assignee: World Class Packaging Systems, Inc., Hilton Head Island, S.C.

[21] Appl. No.: 815,563

[22] Filed: Mar. 12, 1997

[51] Int. Cl.[6] ..... B65D 85/00

[52] U.S. Cl. ..... 426/396; 426/106; 426/129; 426/392; 426/418; 53/432; 53/449; 220/359; 220/360; 220/361; 220/373

[58] Field of Search ..... 426/106, 118, 426/123, 125, 129, 392, 395, 396, 418, 419; 53/432, 449; 220/359, 360, 361, 373

[56] References Cited

U.S. PATENT DOCUMENTS 3,797,694 3/1974 See et al. ..... 426/118 X
3,997,677 12/1976 Hirsch et al. ..... 426/118 X
4,548,824 10/1985 Mitchell et al. ..... 426/396 X
5,587,192 12/1996 Beizermann ..... 426/118
5,667,827 9/1997 Breen et al. ..... 426/129
5,686,127 11/1997 Stockley, III et al. ..... 426/129

*Primary Examiner*—Milton Cano
*Attorney, Agent, or Firm*—Trop, Pruner, Hu & Miles, P. C.

[57] ABSTRACT

A package is capable of enclosing a food product in two different gaseous atmospheres at different times. Initially the food product may be packaged in a low oxygen atmosphere in order to prolong the shelf life of the product. When it is time to sell the product for example, it may be desirable to supply oxygen to the food product. In the case of red meats, the oxygenation process causes the meat to turn a bright red color. The package includes a tray covered by a film with a plurality of apertures formed in the tray. The apertures are covered by a resealable gas impermiable tape which can be removed to allow air ingress and then resealed to protect the integrity of the tray contents.

17 Claims, 6 Drawing Sheets

METHOD OF PACKAGING A FOOD PRODUCT IN A VENTABLE PACKAGE

BACKGROUND OF THE INVENTION

This invention relates generally to methods and apparatus for packaging food products in two distinctly different atmospheric conditions.

For some time now, it has been appreciated that there are considerable advantages to be achieved from a package which can accommodate two distinctly different packaging concerns. The first of those concerns is to extend the shelf life of the product by reducing its exposure to oxygen. This means that the product is advantageously isolated from oxygen exposure from the time the food product is packaged until just before it is ready to go on sale. By avoiding oxygen exposure during this period, the shelf life of the package can be increased because exposure to oxygen is what begins the degradation of the food product. Thus, the product can be transported from a remote location to a point of sale over a number of days without endangering the product. The product's useful life is determined primarily from the time that oxygen exposure is initiated.

The second packaging concern relates to the situation where, particularly with respect to red meat, it is advantageous to expose the meat to oxygen prior to sale. The oxygen exposure causes the meat to turn bright red from its unexposed purple color. As mentioned above, oxygen exposure begins the degradation and thus, it is advantageous to forestall the oxygen exposure to the greatest possible extent.

A number of techniques have been proposed to allow the package to undergo two distinct states. One procedure involves a package which has a pair of films, one of which is permeable and the other of which is impermeable. When the impermeable film is removed, the permeable film remains. Oxygen flow from the atmosphere through the permeable film enables blooming of the food product, at least in the case of red meat.

While existing techniques have many advantages, it would be desirable to achieve many of these advantages, if possible, without having to deal with the requirement of securing two plastic films to the package.

Thus, there would be a considerable demand for a product which efficiently allows a package to experience two distinct packaging states with two distinctly different packaging environments, without the necessity of securing two distinct films to a tray.

SUMMARY OF THE INVENTION

In accordance with one aspect of the present invention, a food package includes a tray with a cavity surrounded by a peripheral flange. A film is secured to the flange over the tray. A passage through the tray is covered by a removable cover. The passage may extend through the sidewall of the tray cavity or through the flange itself. It may be covered, for example, by a removable tape covering. The tape can be peeled back to open the passage.

In accordance with another aspect, two removable covers may be utilized: one on the inside of the tray and one on the outside. The inside covering may be a porous film and the outside covering may be impermeable film. Thus, when the exterior cover is removed, liquid egress is still prevented by the interior cover and likewise contaminant ingress is similarly prevented.

DESCRIPTION OF THE PREFERRED EMBODIMENTS

Figure 1:
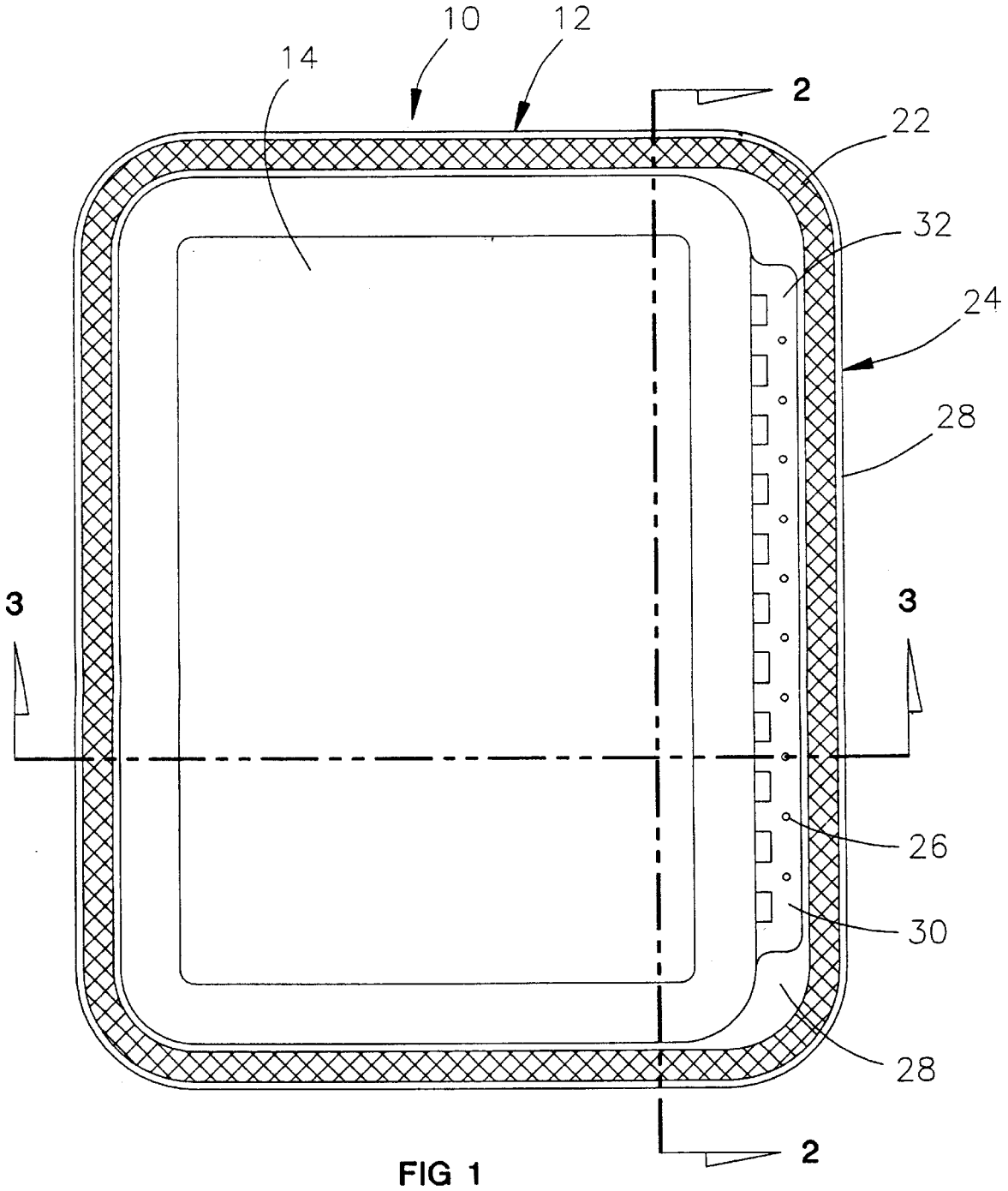
FIG. 1 is a top plan view of one embodiment.

Referring to the drawing wherein like reference characters are utilized for like parts throughout the several views, a food package 10 includes a molded plastic tray 12 covered by a plastic film 14. The plastic film 14 may be any of a variety of films utilized for covering food packages. As shown in FIG. 2, the tray 12 includes a lower surface 16, upwardly extending sidewall 18, and a peripheral flange 20 which extends substantially transversely away from the sidewall 18. The film 14 is secured by conventional techniques to the flange 20 as indicated at 22 in FIG. 1. For example, the film 14 may be heat sealed to the flange 20.

Figure 2:
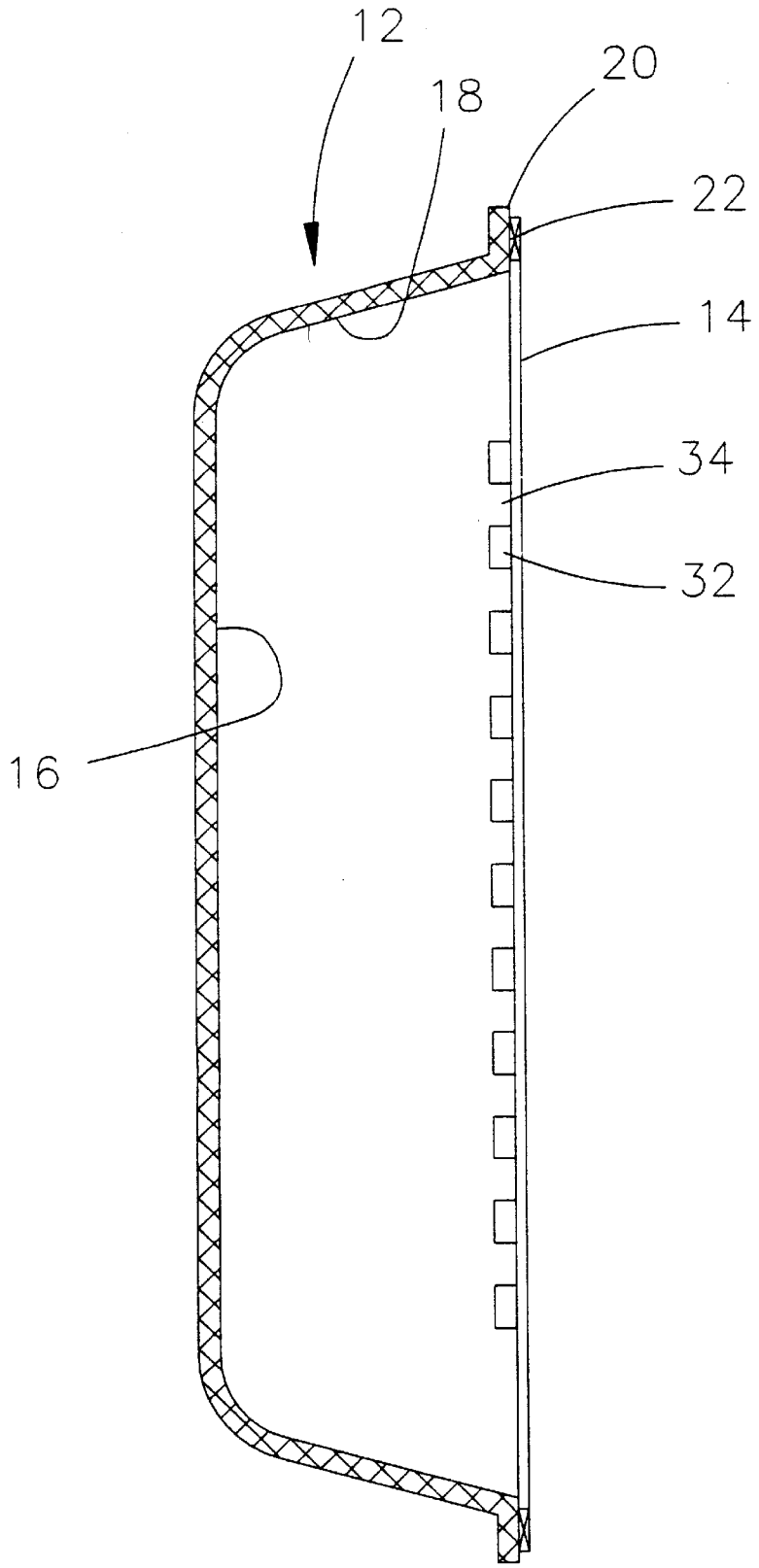
FIG. 2 is a cross-sectional view taken generally along the line 2—2 in FIG. 1.
Figure 3:
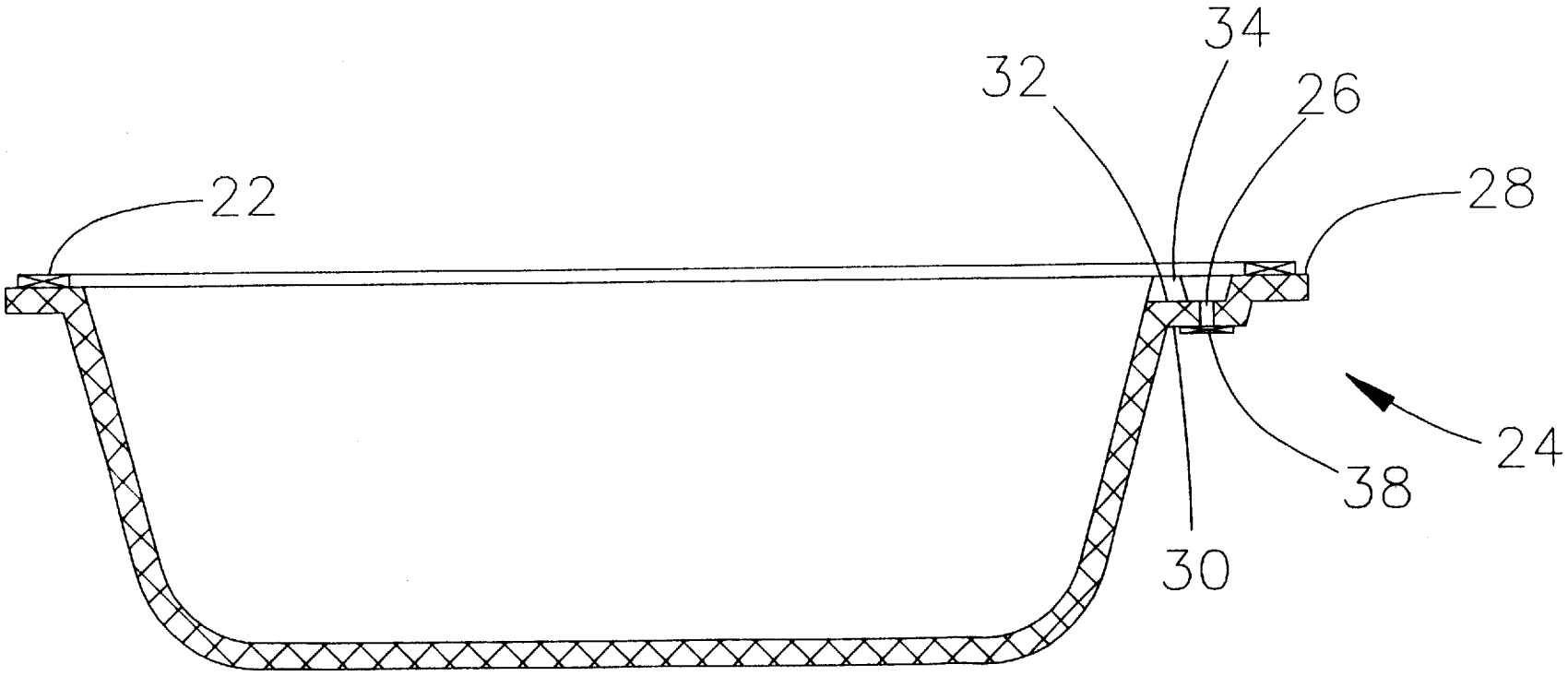
FIG. 3 is a cross-sectional view taken generally along the line 3—3 in FIG. 1.

As shown in FIGS. 1 and 3, one flange portion 24 may be of greater width than the remaining portions to accommodate a plurality of air passages 26, which selectively allow air ingress into the package interior. The flange portion 24 includes a film sealing area 28 and a passage area 30. The sealing area 28 is conventional in all respects and corresponds generally to the similar area on the remainder of the flange 20. The passage portion 30 includes a depression 32 which may be formed by appropriate molding techniques used for making the tray 12. The depression 32 is punctuated by a plurality of protrusions 34 which extend upwardly through the depression 32, situated to support the plastic film 14 in a substantially level configuration with the upper surface of the remainder of the flange 20.

The plurality of passages 26 extend through the passage portion 30 and exit on the lower surface of the flange portion 24. Each of the passages 26 may be substantially vertically oriented and together provide for the possibility of air ingress from the exterior, through the passage 26 via the depression 32 into the cavity formed by the lower surface 16 and upstanding sidewall 18 of the tray 12.

The exterior opening of the passage 26 may be covered by a piece of removable tape 38. The tape 38, in position, closes the passages 26, but when peeled back allows gas communication with the interior of the package 10.

Figure 4:
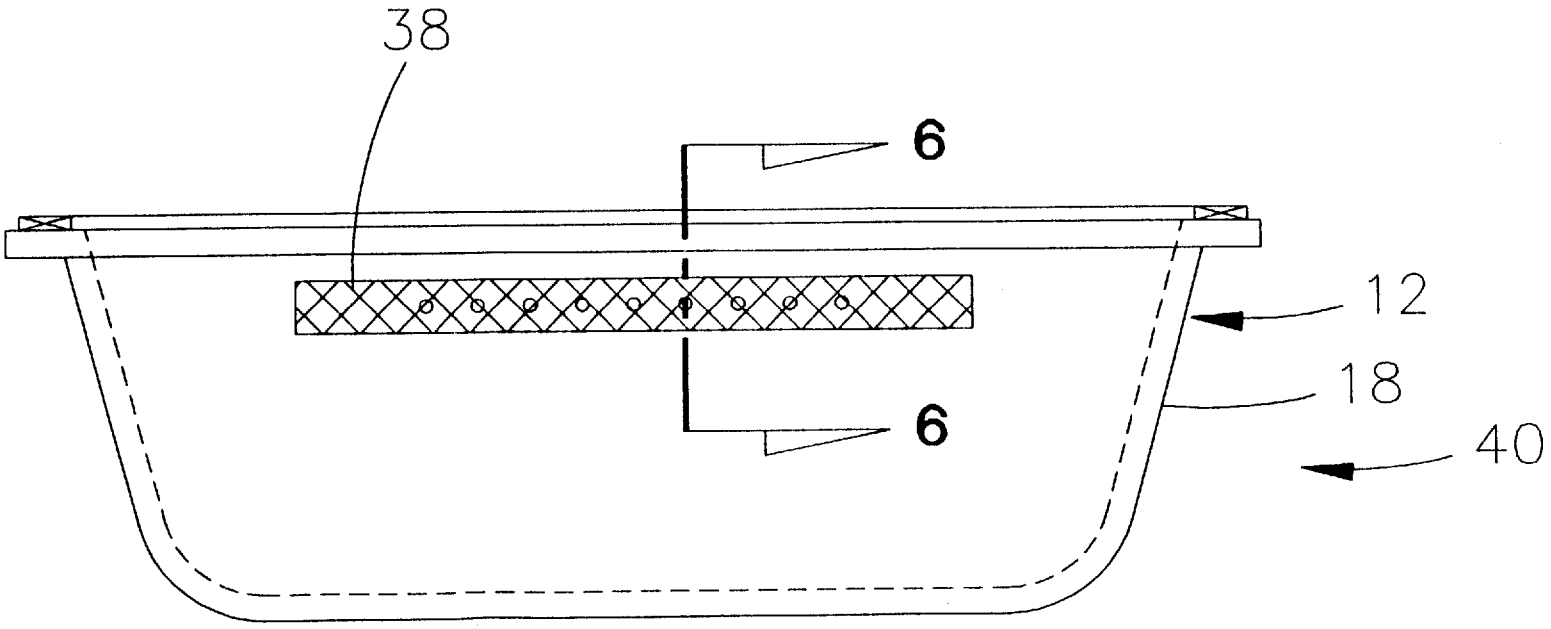
FIG. 4 is a side elevational view of another embodiment.
Figure 5:
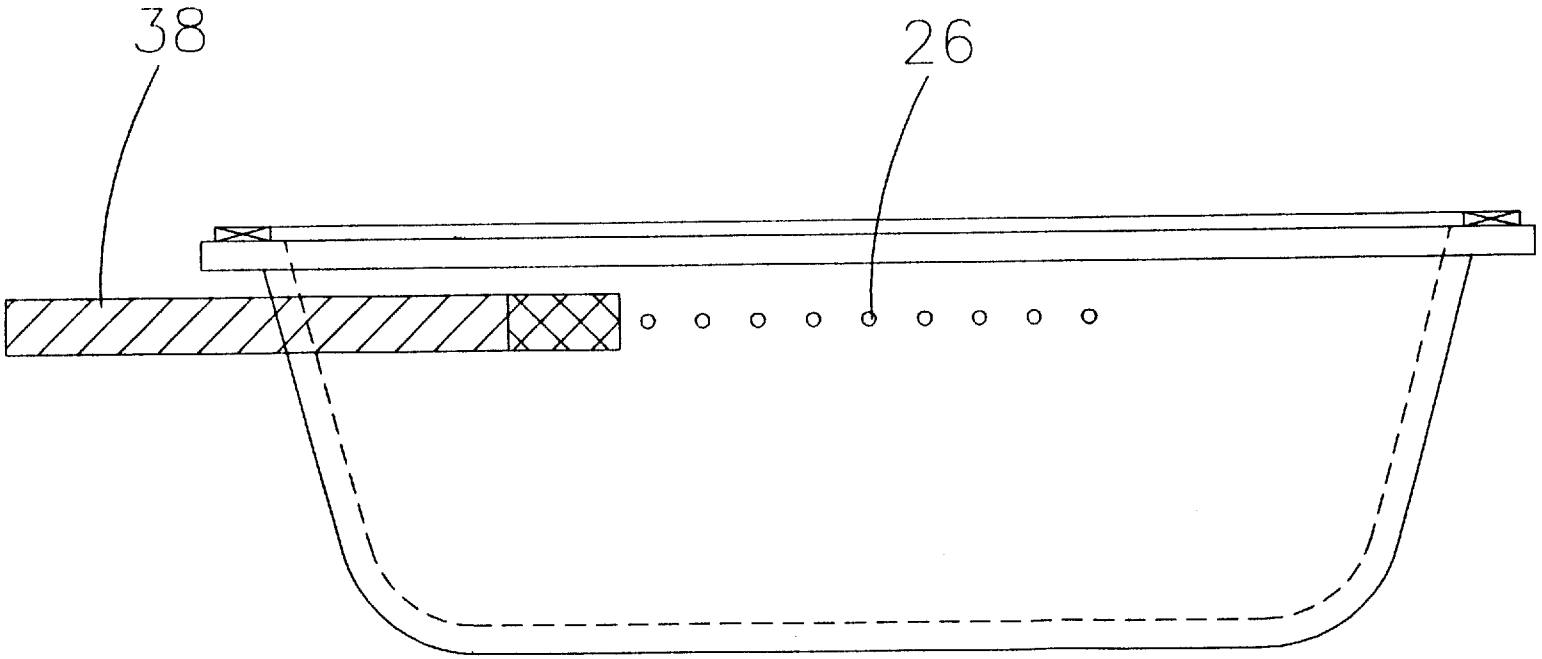
FIG. 5 is a side elevational view of the embodiment shown in FIG. 4 with the cover partially removed.
Figure 6:
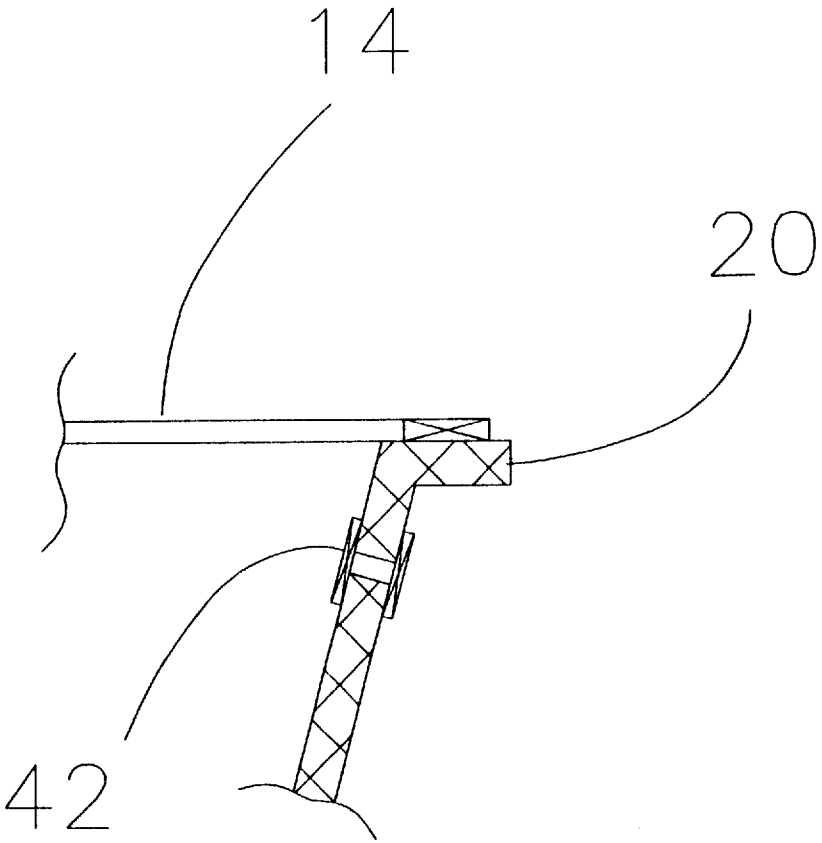
FIG. 6 is an enlarged cross-sectional view taken generally along the line 6—6 in FIG. 4.

Another embodiment, shown in FIGS. 4 through 6, includes a package 40 with a tray 12 having an upstanding sidewall 18 and a lower surface 16, together with a peripheral flange 20. The film 14 may be secured by heat sealing the film onto the peripheral flange 20. As in the previous embodiment, a film 14 is secured by heat sealing the film onto the peripheral flange 20.

A plurality of passages 26 are formed through the upstanding sidewall 18 of the tray 12 proximate to the flange 20. On the exterior of the package, the apertures 26 are covered by a tape 38, which may be peeled back to open the outside entrance to the passages 26.

As shown in FIG. 6, the interior of each passage 26 could also be covered by a gas permeable tape 42 which is secured to the interior surface of the upstanding sidewall 18 over the interior opening of the passages 26. By making the tape 38 substantially impermeable to gas, the tape 38 prevents gas flow into or out of the package. When the tape is removed as indicated in FIG. 4, the tape 42 on the interior of the package is useful to prevent liquid outflow and contaminant inflow.

It is also possible to use a single tape 38 on the exterior of the package, which is made up of two separable pieces which may be independently removed. The outermost being an impermeable film and the innermost being a permeable film to allow gas exchange after the outermost film has been removed.

In use, a food product such as a piece of meat may be enclosed inside the tray 12 by sealing a film 14 to the flange 20. Because it is done in a low oxygen atmosphere i.e. a substantially inert atmosphere shelf life of the meat product may be substantially extended. However, because of the consumer's desire to purchase meat which is of a red bloomed color, it is necessary to expose the meat to oxygen proximate to the time of sale. In the embodiment shown in FIGS. 1 through 3, this would be done by removing the tape 38 allowing air ingress through the passages 26 and into the tray 12 via the depression 32. The integrity of the air flow passageway is insured by the presence of the protrusions 34.

Similarly in the embodiment shown in FIGS. 4 through 6, air exchange is provided by removing the exterior tape 38 covering the upstanding sidewall 18 and particularly the passages 26. Once removed, air exchange is possible.

In each case it may be desirable to replace the tape covering 38 after blooming has been achieved. If the tape 38 is resealable, this can be easily accomplished with the same piece of tape that was previously removed. That is, after the meat has bloomed, the tape covering 38 can be replaced.

While the present invention has been described with respect to a limited number of embodiments, those skilled in the art will appreciate a number of modifications and variations therefrom. It is intended that the appended claims cover all such modifications and variations as fall within in the true spirit and scope of the present invention.

What is claimed is:

1. A food package comprising:

a tray having a cavity surrounded by a peripheral flange, said tray cavity containing a food product therein;

a film sealed to said flange over said tray; and a plurality of passages through said tray covered by a removable tape.

2. The package of claim 1 wherein said tape is resealable.

3. The package of claim 1 wherein said passage extends through said flange.

4. The package of claim 1 wherein said tray includes a lower surface and an upstanding sidewall connected to said flange, said passage extending through said sidewall.

5. The package of claim 1 wherein said flange includes a first portion which sealingly connects to said film and a second portion inboard of said first portion, which includes a depression which allows the outside atmosphere to be communicated through said passage via said depression into said tray.

6. The package of claim 5 wherein said depression includes a plurality of spaced protrusions which extend upwardly through the depression and serve to support said film over said depression.

7. The package of claim 1 wherein said tray includes a substantially impermeable cover.

8. The package of claim 1 wherein said tray includes a permeable cover.

9. A tray for holding food products comprising:

a cavity having a lower surface and an upstanding peripheral wall connected thereto, said cavity containing a food product therein;

a flange connected to said upstanding peripheral wall adapted to sealingly engage a film cover;

a plurality of passages extending through said tray to allow selective communication with the exterior of said tray; and a gas impermeable adhesive tape secured over said passages.

10. The tray of claim 9 wherein said tape is resealable.

11. The tray of claim 9 wherein said passage extends through said flange.

12. The tray of claim 11 wherein said flange includes an outer peripheral sealing region and at least a portion of said flange includes a region for providing airflow passage from the interior of said package to the exterior, said portion including a plurality of upstanding protrusions which extend from the flange upwardly to support the film cover.

13. The tray of claim 9 including a plurality of apertures through said upstanding peripheral wall.

14. A method for packaging food comprising the steps of:

placing a food product in a tray;

supplying a low oxygen content atmosphere inside said tray and covering said tray with a barrier film;

forming a plurality of apertures in said tray; and closing said apertures using an gas impermiable adhesive tape situated on the outside of said tray over said apertures.

15. The method of claim 14 including the step of removing said tape in order to exhaust said low oxygen content atmosphere and to replace it with normal atmospheric air.

16. The method of claim 15 including the step of resealing said tape over said apertures after a period of time has passed.

17. The method of claim 14 including the step of preventing contaminant inflow into said package through said apertures after said tape has been removed.

* * * * *